US006357259B1

(12) United States Patent
Higginbotham et al.

(10) Patent No.: US 6,357,259 B1
(45) Date of Patent: Mar. 19, 2002

(54) AIR SEPARATION METHOD TO PRODUCE GASEOUS PRODUCT

(75) Inventors: Paul Higginbotham, Guildford (GB); Niranjan Sundaram, St. Charles, IL (US); Leighton B. Wilson, North Plainfield, NJ (US); Joseph Straub, North Haledon, NJ (US); Joseph P. Naumovitz, Lebanon, NJ (US)

(73) Assignee: The BOC Group, Inc., Murray Hill, NJ (US)

( * ) Notice: Subject to any disclaimer, the term of this patent is extended or adjusted under 35 U.S.C. 154(b) by 0 days.

(21) Appl. No.: 09/672,489

(22) Filed: Sep. 29, 2000

(51) Int. Cl.[7] ..... F25I 1/00
(52) U.S. Cl. ..... 62/656; 62/654; 62/913
(58) Field of Search ..... 62/656, 913, 654

(56) References Cited

U.S. PATENT DOCUMENTS 4,529,425 A * 7/1985 McNeil ..... 62/913
5,084,081 A * 1/1992 Rohde ..... 62/656
5,209,070 A * 5/1993 Darredeau ..... 62/913
5,505,052 A * 4/1996 Ekins et al. ..... 62/913
5,526,647 A * 6/1996 Grenier ..... 62/654
5,941,098 A * 8/1999 Guillard et al. ..... 62/656

* cited by examiner

*Primary Examiner*—Ronald Capossela
(74) *Attorney, Agent, or Firm*—Salvatore P. Pace

(57) ABSTRACT

A method of producing a gaseous product, for instance gaseous oxygen in accordance with a cyclical demand pattern having high and low periods of demand. During periods of high demand, liquid is vaporized against condensing air which is in turn stored. During low demand periods, product is accumulated and previously stored liquid air is introduced into the column. During both high and low periods of demand liquid product is drawn to reduce the percentage variance in the required flow rate to the booster compressor used in producing the air to be liquefied. Preferably, during periods of high demand, a turbine used in generating refrigeration can be turned down to increase the amount of air available for condensation and with a reduction in production of liquid product.

13 Claims, 1 Drawing Sheet

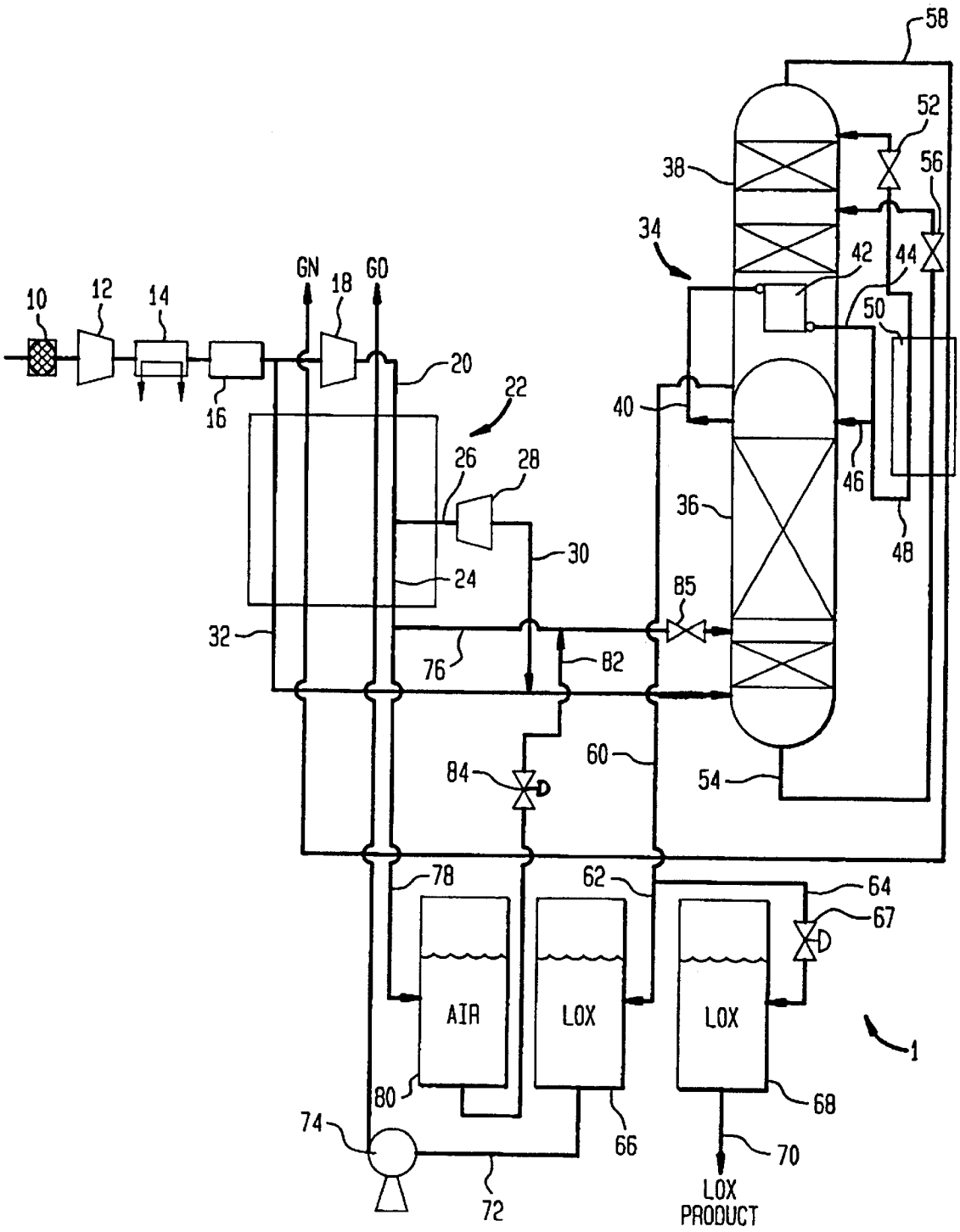
58
52
56
38
34
42
44
50
GN
18
GO
10
12
14
20
22
16
40
26
28
46
36
30
48
24
85
32
76
82
60
84
54
78
62
64
67
AIR
LOX
LOX
1
80
68
74
66
70
72
LOX
PRODUCT

AIR SEPARATION METHOD TO PRODUCE GASEOUS PRODUCT

BACKGROUND OF THE INVENTION

The present invention relates to a method of separating air to produce a gaseous product in accordance with the demand cycle. More particularly, the present invention relates to such a method in which during periods of high demand air is liquefied and stored against vaporizing a product stream and during periods of low demand at least part of the product to be vaporized during the high demand period is stored. Even more particularly, the present invention relates to such a method in which liquid product is continually produced to decrease the magnitude of variation in the air flow rate to compression machinery.

There are various processes and apparatus that have been provided in the prior art to separate air and thereby produce gaseous products in accordance with a demand cycle. During a demand cycle, demand cyclically swings between periods of high and low demand. In accordance with such demand, more gaseous product is produced during the high demand period than during the low demand period. This type of production requirement is often required in industries having a cyclical demand for oxygen, such as in the production of steel.

In an example of an air separation plant designed to function in accordance with a demand cycle, air after having been filtered, is compressed. The heat of compression is removed and the air is further purified of moisture, carbon dioxide and etc. Thereafter, part of the air is cooled to around its dew point temperature and is introduced into the bottom of a double distillation column system. In a double distillation column system, higher and lower pressure columns are connected to one another in a heat transfer relationship to produce liquid oxygen as a bottoms product of the lower pressure column. Another part of the air to be separated is compressed in a booster compressor and is then divided so that part of the air is partly cooled and turbo expanded to produce plant refrigeration and another part of the air is fully cooled.

During periods of high demand, liquid oxygen that has been previously produced during a low demand period and stored within a storage tank is pressurized by being pumped and then fully vaporized within the main heat exchanger against condensing the other part of the air that had been boosted in pressure and fully cooled. The resultant condensed air stream is in part stored and in part introduced into the higher pressure distillation column. During the low demand period, the previously stored liquid air is supplied to the higher pressure distillation column.

A practical difficulty in effectuating a process such as been described above is that during periods of high demand, more air must be further compressed and therefore liquefied in order to vaporize the increase in the flow rate of product. Inlet flow to the booster compressor can vary by as much as 50%. Most known compressors are not able to accommodate such a variation of inlet flow without recirculation of the outlet flow. Thus, in order to accommodate a 50% of design flow rate, part of the outlet flow of the compressor must be recirculated back to the inlet. The compressor must be sized, however, to produce the requisite outlet flow. As a result, the booster compressor has an over capacity when flow rates are 50% and therefore, practically, a larger compressor is used than would theoretically be necessary. This is not efficient from standpoints of both equipment cost and electrical power usage.

As will be discussed, the present invention operates a demand cycle so that there are not excessive swings of air flow rate to the booster compressor to allow for more efficient compressor utilization.

SUMMARY OF THE INVENTION

The present invention relates to a method for separating air to produce a gaseous product enriched in a component of the air and in accordance with the demand cycle having high and low periods of demand. In accordance with the method, first and second liquid streams are produced by the cryogenic rectification of the air. The first liquid stream is enriched in the component of the air that will eventually form the product. It is to be noted that the term "cryogenic rectification" as used herein and in the claims encompasses a process in which air is compressed and cooled to around its dew point and then is distilled in one or more distillation columns.

During the period of low demand, a supply of stored product is formed from at least part of the liquid stream. During the high period of demand, a product stream is formed from at least part of the stored liquid product and is pressurized. Thereafter the product stream is vaporized to produce the gaseous product. At the same time, a first further compressed air stream, passing in indirect heat exchange with the product stream, is condensed. It is to be noted that the term "condensing" as used herein and in the claims encompasses not only a process in which a substance changes state from a vapor to a liquid, but also to processes in which a super critical fluid is depressurized, after having been fully cooled, to produce a liquid. During at least the low period of demand, refrigeration is produced by expanding a second further compressed air stream with performance of work, thereby to refrigerate the low temperature rectification process and to permit production of the first and second liquid streams and also, producing a liquid product composed of the second liquid stream. As a result, the flow rate of the air to be further compressed during the low period of demand is greater than that that would otherwise have been required had the liquid product not been produced.

The advantage of the foregoing method is that increasing the air flow rate of the air to be further compressed, while resulting in an increase in compression requirements, actually reduces the required percentage increase between high and low demand periods that would otherwise have occurred. As will be discussed, product production can be made to vary as can the amount of further compressed air that serves refrigeration purposes. In such a manner, the air that is further compressed can serve in vaporizing the pressurized liquid product and thus air flow swings to the main air compressor can be further reduced. In fact, a process can be carried out in which the air flow rate to the booster compressor remains unchanged during periods of both high and low demand.

BRIEF DESCRIPTION OF THE DRAWINGS

While the specifications concludes with claims distinctly pointing out the subject matter that applicants regard as their invention, it is believed that the invention will be better understood when taken in connection with the accompanying sole FIGURE which is a schematic illustration of an apparatus for carrying out a method in accordance with the present invention.

DETAILED DESCRIPTION

With reference to the FIGURE, air separation apparatus 1 in accordance with the present invention is illustrated that can be used to produce both gaseous nitrogen and gaseous oxygen products.

In accordance with a method of operation of air separation apparatus 1, air after having been filtered in a filter 10 is compressed by a main air compressor 12. The heat of compression is removed from the resultant compressed air by an after-cooler 14. The air is further purified by removal of impurities such as carbon dioxide and moisture by a known prepurification unit 16. The air is further compressed by a booster compressor 18 to form a further compressed air stream 20. Further compressed air stream 20 is introduced into a main heat exchanger 22 where it is cooled against other warming streams passing countercurrently through main heat exchanger 22. Although main heat exchanger 22 is illustrated as a single unit, in practice, the heat exchanger might be a heat exchanger complex of several heat exchangers.

Further compressed air stream 20 after having been partly cooled, that is cooled to a temperature that is between the warm and cold ends of main heat exchanger 22, is divided into first and second further compressed air streams 24 and 26. First further compressed air stream 24 is cooled to liquefaction temperatures and second further compressed air stream 26 is turboexpanded within a turboexpander 28 to produce a refrigerant stream 30. Refrigerant stream 30 adds refrigeration to air separation apparatus 1 and helps in making a liquid product. In the illustrated embodiment, turboexpander 28 provides all refrigeration. It is possible, however, to conduct a method in accordance with the present invention by supplementing the refrigeration by liquid assist as for instance during periods of high demand for product. In fact during such high periods of demand, all of the refrigeration might be supplied by liquid assist.

A compressed air stream 32 is formed by diversion of part of the prepurified air to booster compressor 18. Compressed air stream 32 is cooled to its dew point and combined with refrigerant stream 30. The resultant stream is introduced into the bottom of an air separation unit 34.

Air separation unit 34 consists of a higher pressure column 36 and a lower pressure column 38. Higher and lower pressure columns 36 and 38 contain mass transfer elements, which can consist of trays or packing, either random or structured. Higher pressure column 36 functions to distill the incoming air to produce a nitrogen rich tower overhead and a crude liquid oxygen column bottoms. Higher pressure column 36 is refluxed by removing a nitrogen rich stream 40 and condensing such stream in a condenser reboiler 42 to produce a reflux stream 44. Reflux stream 44 is divided into two parts. One part 46 is used to reflux higher pressure column 36. The other part 48 is subcooled within the subcooling unit 50, valve expanded by an expansion valve 52 to the pressure of the lower pressure column 38, and then introduced as reflux into lower pressure column 38.

The crude liquid oxygen produced as a column bottoms of higher pressure column 36 is extracted as a crude liquid oxygen stream 54 for further refinement in the lower pressure column 38. Crude liquid oxygen stream 54 is subcooled within subcooling unit 50 and valve expanded by an expansion valve 56 before introduction into lower pressure column 38 for further refinement. This further refinement produces an oxygen rich liquid column bottoms within lower pressure column 38. The oxygen rich liquid column bottoms is boiled by condenser-reboiler 42 to produce boilup within lower pressure column 38. It is to be noted that the terms "enriched" (as used in the claims) or "oxygen rich liquid" has no specific connotation of purity. The present invention thus contemplates high purity products, to wit: above 99% as well as well below high purity, for instance, oxygen enriched air at 30%. Lower pressure column 38 also produces a gaseous nitrogen stream 58 which passes counter currently through subcooling unit 50 to subcool part 48 of reflux stream 44 and crude liquid oxygen stream 54 before fully warming within heat exchanger 22 and being discharged from the process.

Apparatus 1 is designed to function to produce a liquid oxygen product at elevated pressure at greater output during high periods of demand then that required at low periods of demand. Thus, apparatus 1 in a manner well known in the art is controlled in a known manner to cyclically operate in accordance with such a demand pattern.

In order to produce the liquid oxygen product the liquid oxygen stream 60 is extracted from the lower pressure column 38 and divided into first and second liquid streams 62 and 64 the first stream 62 is introduced into a liquid storage tank 66 and second liquid stream 64 is introduced into liquid product tank 68 from which liquid oxygen product stream 70 can be extracted. As may be appreciated, liquid storage and product tanks 66 and 68 could be the same tank. A liquid product stream 72 composed of the liquid oxygen to be vaporized is pumped by a pump 74 for pressurization purposes then vaporized within main heat exchanger 22 to produce the gaseous oxygen product at pressure. As is known in the art, in lieu of pump 74, hydrostatic head can be utilized for production of such pressurization.

During periods of high demand, more liquid air will be produced so that the excess of liquid air going in stream 78 is routed to tank 80 to accumulate liquid air. At the same time, liquid oxygen within liquid oxygen product tank 68 is being depleted It can be entirely depleted and used in its entirety in forming liquid product stream 72 or it can be used to augment liquid product stream 72 so that only part of liquid product stream 72 is formed from stored liquid. During periods of low demand, liquid oxygen stores within liquid oxygen storage tank 66 are built up and liquid air previously accumulated in liquid air storage tank 80 is combined as a stored air stream 82 with part 76 of the condensed air. This is effectuated by opening a valve 84. The combined stream is then introduced into higher pressure column 36 after being expanded to pressure by an expansion valve 85. In such manner liquid flow to the column is kept relatively constant during both high and low demand periods. As may be appreciated, liquid air could be produced in surplus amounts so as to be available as a liquid air product.

It is to be noted that the present invention covers a process in which no liquid air need be stored. Thus, it is possible to design a cycle in accordance with the present invention in which during periods of high demand, all liquid air would be introduced into the column for separation. A further point is that in case of supercritical air, then liquid air would be stored within liquid air storage tank 80 is a pressure less than supercritical. This would be effectuated by valve expanding the supercritical air. The resultant vapor fraction produced by such expansion would be introduced into the distillation column.

As stated above, it is not efficient to incorporate an operation in which booster compressor 18 is subjected to large swings in flow rates. In the subject invention, apparatus 1 is continually loaded by production of a liquid product in addition to the gaseous product. As a consequence, there is always some refrigeration requirement that is supplied by the use of booster compressor 18 and therefore, the flow rate thereto will not vary to the same degree had no liquid been produced. During periods of high demand, turboexpander 28 is turned down. In this regard, turboexpanders such as turboexpander 28 and provided with variable inlet vanes to control the flow thereto. The illustrated compressor 18 is provided with a similar arrangement. Turning down turboexpander 28 will cause an excess flow, that would otherwise have gone into turboexpander 28 to form the make-up of first further compressed air stream 24. Such operation provides more available air to be liquefied and therefore vaporize liquid oxygen product stream 72. Since, however, there will be less refrigeration, there will be less liquid produced and thus, valve 67 will be turned down so that more liquid oxygen will flow to liquid oxygen storage tank 66. As may be appreciated, the entire system may be adjusted so that booster compressor 18 sees no change in air flow and main air flow compressor 12 sees only a slight change in air flow.

Calculated examples are set forth in the following chart of three possible liquid production schemes. Case 1 is a prior art production in which no liquid is produced. Case 2 involves the production of a liquid product in the amount of 30 tons per day. Lastly, Case 3 involves an average liquid production of 30 tons per day. The liquid production in case 3 is not however constant and varies.

| | CASE I | | CASE II | | CASE III | |
|---|---|---|---|---|---|---|
| | Low Demand | High Demand | Low Demand | High Demand | Low Demand | High Demand |
| Total Gaseous Oxygen Production (Tons/Day) | 70 | 210 | 70 | 210 | 70 | 210 |
| Stream 62 (Tons/Day) | 140 | 140 | 140 | 140 | 140 | 140 |
| Stream 64 (Tons/Day) | — | — | 30 | 30 | 42.8 | 17 |
| Booster Compressor 18 Flow Rate ($Nm^3$/hr) | 6049 | 11634 | 12621 | 18205 | 15383 | 15383 |
| Main Air Compressor 12 Flow Rate ($Nm^3$/hr) | 15335 | 20919 | 19212 | 24804 | 20786 | 23135 |
| Stream 60 (Tons/Day) | 140 | 140 | 170 | 170 | 182.8 | 157 |
| Stream 78 ($Nm^3$/hr) | — | 2792 | — | 2792 | — | 2792 |
| Stream 82 ($Nm^3$/hr) | 2792 | — | 2792 | — | 2792 | — |

The charted example of Case I shows a flow to booster compressor 18 varying (between high and low demand periods) at about 48%. In Case II where there is some liquid production in accordance with the present invention, the variance is reduced to about 31%. In case III the flow to booster compressor 18 is constant.

The present invention has applicability not only to pressurized oxygen production but also to plants that are designed to produce a pressurized nitrogen product. Additionally, although liquid oxygen is the liquid product that is being produced, similar operation could be effectuated by drawing off a liquid nitrogen product. A further point is that in any apparatus constructed in accordance with the method of the present invention, although single stage of turbo expansion is illustrated, as would be known to the skilled in the art, efficiencies could be realized by providing several stages of turbo expansion at differing temperatures. Further the present invention could also have provision for an argon column to produce argon A still further point is that the liquid oxygen to be pumped (or any other pressurized liquid product) could be stored in a pressurized state. This would allow the pump to run at a constant nominal rate to conserve energy.

Although the present invention has been described with reference to preferred embodiment, as will occur to the skilled in the art, numerous changes, additions, and omissions may be made without departing from the spirit and scope of the present invention.

We claim:

1. A method of separating air to produce a gaseous product, enriched in a component of the air and in accordance with a demand cycle having high and low periods of demand, said method comprising:

producing first and second liquid streams by cryogenic rectification of the air, the first liquid stream being enriched in said component of the air;

during the low period of demand, forming a supply of stored product from said first liquid stream;

during the high period of demand, pressurizing a first product stream formed from at least part of the stored liquid product, vaporizing said product stream to produce said gaseous product, and condensing a first further compressed air stream passing in indirect heat exchange with said product stream; and during at least the low period of demand, producing refrigeration by expanding a second further compressed air stream with performance of work, thereby to refrigerate said low temperature rectification process and to permit production of said first and second liquid stream and also, to produce a liquid product composed of said second liquid stream;

whereby an air flow rate of the air to be further compressed during the low period of demand is greater than that otherwise required had said liquid product not been produced.

2. The method of claim 1, further comprising, during said high demand period, increasing a first flow rate of said first further compressed air stream, decreasing a second flow rate of said second further compressed air stream thereby to decrease said refrigeration and to decrease production of the liquid product, the first flow rate of said further compressed air stream being sufficiently increased to allow for vaporization of said product stream.

3. The method of claim 2, wherein said first flow rate is increased and said second flow rate is decreased so that said air flow rate of the air to be further compressed does not vary between high and low demand periods.

4. The method of claim 1, claim 2, or claim 3, wherein said product stream is pressurized by being pumped.

5. The method of claim 4, wherein said component comprises oxygen.

6. The method of claim 5, wherein said liquid stream is also enriched in said component.

7. The method of claim 1, wherein:

during the low period of demand stored liquid air is introduced into the low temperature rectification process as part of the air to be separated; and during the high period of demand, a supply of said stored liquid air is formed from part of said first further compressed air stream after having been condensed.

8. The method of claim 1 or claim 7, wherein during both the high and low periods of demand, refrigeration is produced by expanding said second further compressed air stream with the performance of work.

9. The method of claim 8, further comprising, during said high demand period, increasing a first flow rate of said first further compressed air stream, decreasing a second flow rate of said second further compressed air stream thereby to decrease said refrigeration and to decrease production of the liquid product, the first flow rate of said further compressed air stream being sufficiently increased to allow for vaporization of said product stream.

10. The method of claim 9, wherein said first flow rate is increased and said second flow rate is decreased so that said air flow rate of the air to be further compressed does not vary between high and low demand periods.

11. The method of claim 10, wherein said product stream is pressurized by being pumped.

12. The method of claim 11, wherein said component comprises oxygen.

13. The method of claim 12, wherein said liquid stream is also enriched in said component.

* * * * *